United States Patent [19]

Bida

[11] Patent Number: 4,942,338

[45] Date of Patent: Jul. 17, 1990

[54] METHOD AND APPARATUS FOR PLASMA CONTAINMENT

[75] Inventor: Sam Bida, Ely, Nev.

[73] Assignee: Sam Bida, Ely, Nev.

[21] Appl. No.: 171,437

[22] Filed: Mar. 21, 1988

[51] Int. Cl.[5] ..... H05H 1/04

[52] U.S. Cl. ..... 315/111.71; 315/111.21; 315/111.41; 313/161; 313/231.31; 376/121

[58] Field of Search ..... 315/111.01, 111.11, 315/111.21, 111.41, 111.51, 111.71; 376/121, 136, 142, 133; 313/157, 161, 362.1, 153, 231.41, 231.31

[56] References Cited

U.S. PATENT DOCUMENTS

| | | | |
|---|---|---|---|
| 3,278,796 | 10/1966 | Takei et al. | 315/111.41 |
| 3,283,205 | 11/1966 | DeBolt | 315/111.41 |
| 3,442,758 | 5/1969 | Penfold et al. | 376/123 |
| 3,523,206 | 8/1970 | Drabier et al. | 313/161 |
| 3,681,710 | 8/1972 | Lary et al. | 313/161 X |
| 4,229,679 | 10/1980 | Lode | 313/161 X |
| 4,263,096 | 4/1981 | Ohkawa et al. | 376/142 |
| 4,654,561 | 3/1987 | Shelton | 376/122 X |
| 4,663,932 | 5/1987 | Cox | 315/5.41 X |
| 4,745,338 | 5/1988 | Hollis, Jr. et al. | 315/111.41 X |

FOREIGN PATENT DOCUMENTS 2907030 8/1980 Fed. Rep. of Germany ..... 376/133

*Primary Examiner*—Eugene R. Laroche
*Assistant Examiner*—Seung Ham
*Attorney, Agent, or Firm*—Watson, Cole, Grindle & Watson

[57] ABSTRACT

Ionized gas is provided by a feed tube and is formed into a generally spherical body of plasma having an oscillating magnetic field. Three rotatable wheel-like members are disposed symmetrically about the body of plasma and are rotated in synchronism in such a direction that the portions of the rotatable member adjacent the body of plasma move upwardly and away from the body. The movable members move in planes disposed generally radially of the body of plasma. The movable members each include bands of high permeability material which cooperate with the magnetic field to produce forces of magnetic attraction which retain the body of plasma in a central suspended position spaced from the rotatable members. The lower portions of the rotatable members are cooled by a circulating coolant.

18 Claims, 2 Drawing Sheets

METHOD AND APPARATUS FOR PLASMA CONTAINMENT

BACKGROUND OF THE INVENTION

The present invention relates to the containment of plasma for prolonged periods of time. In certain induced reactions such as nuclear fusion, an ionized plasma is formed, and it is necessary to provide means for containment of the plasma.

Various arrangements have been employed in the prior art, and U.S. Pat. No. 3,442,758 discloses the use of an external high frequency rotating magnetic field for confining an ionized gas plasma. This type of device produces an inductive potential having a zone of reduced intensity near the center of rotation of the magnetic field, and the ionized gas is concentrated in this zone. Either coaxial coils or a microwave structure may be employed to produce the desired high frequency magnetic field.

SUMMARY OF THE INVENTION

The invention is based on the novel concept of utilizing the magnetic field of a body of plasma in combination with movable means including portions of high permeability material to produce forces which will contain the plasma body. These portions of high permeability material are moved adjacent the plasma body in such a direction as to apply forces of magnetic attraction to the body of plasma which will retain the plasma in a desired suspended position. The present invention provides means for supplying ionized gas to form a generally spherical body of plasma having its own oscillating magnetic field.

The movable means preferably takes the form of a plurality of rotatable wheel-like members which are substantially equally spaced about the body of plasma and which rotate in planes which are disposed generally radially of the spherical plasma body. The rotation of the wheels is synchronized, and the portions of the rotatable members adjacent the body of plasma move upwardly and away from or outwardly of the body to thereby apply forces of magnetic attraction to the body which will confine it in a suspended central position between and spaced from the wheels.

DETAILED DESCRIPTION OF THE INVENTION

Figure 1:
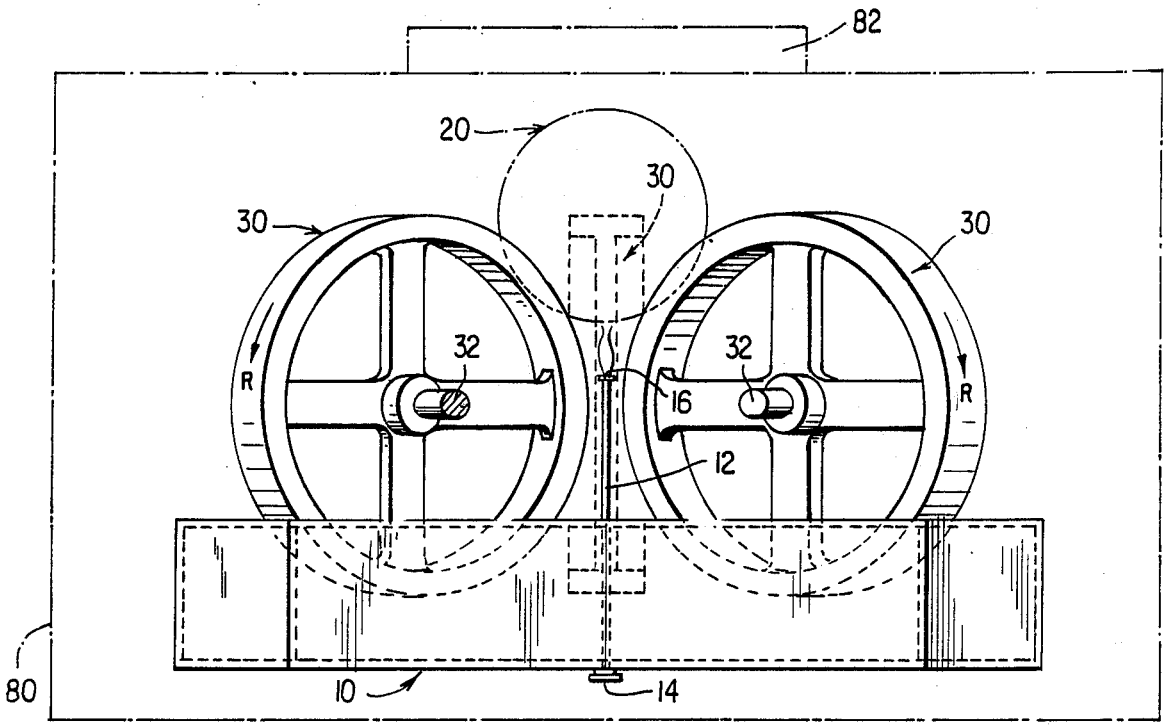
FIG. 1 is a somewhat schematic side elevation of the apparatus of the present invention.
Figure 2:
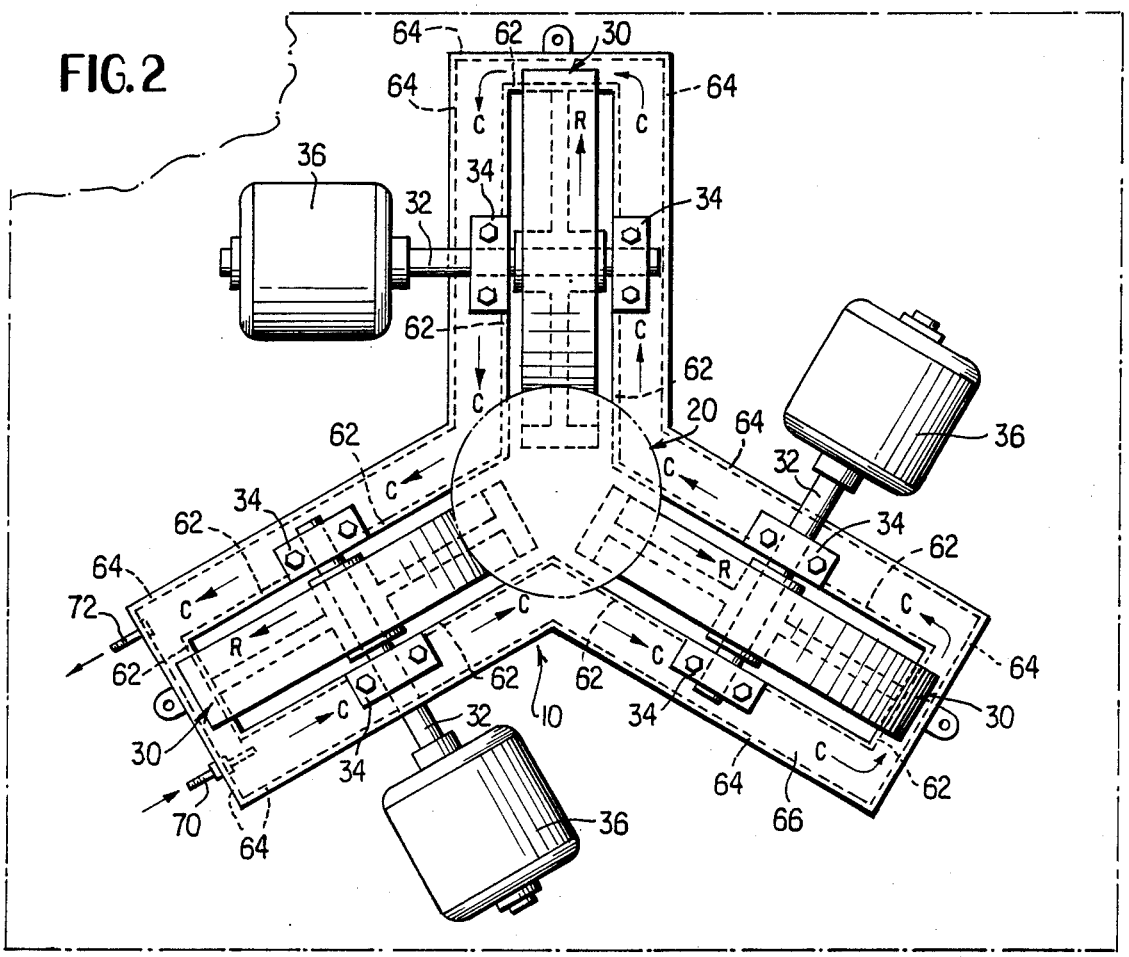
FIG. 2 is a plan view of the apparatus shown in FIG. 1 illustrating the apparatus in more detail.

Referring now to the drawings wherein like reference characters designate corresponding parts throughout the several views, the general arrangement of the invention is shown in FIGS. 1 and 2 wherein a base structure indicated generally by reference numeral 10 is adapted to support the movable means of the device as well as serving to provide cooling of the movable means as hereinafter described.

A means for providing a body of ionized plasma comprises feed tube 12 supported at the center of the base and which extends vertically upwardly. The lower end 14 of the feed tube is adapted to be connected with a suitable source of ionized gas such as water, hydrogen, cesium, potassium, sodium or other suitable gases. The gas is ionized in a well-known manner such as by radiation, high temperatures, alpha particles or fast moving electrons. The upper discharge end 16 of the feed tube discharge gas therefrom in an upward direction to form a body of plasma indicated by reference numeral 20. This body of plasma has its own oscillating magnetic filed.

As seen most clearly in FIG. 2, the retaining means for retaining the body of plasma in suspended position comprises three movable means 30 in the form of wheel-like members which are of similar construction, each of these members being fixed to a drive shaft 32 which is rotatably supported in spaced journals 34. One end of the drive shafts 32 is connected to a synchronous motor 36, the three motors being driven in synchronism with one another such that the movable members 30 rotate at substantially the same speeds. These motors may be supported in any suitable manner.

It will be noted that the movable members 30 are spaced from one another and are disposed symmetrically about the body of plasma 20 which assumes a generally spherical configuration. Accordingly, when three movable members employed, they will be aligned in such a manner as to be spaced 120° degrees from one another. Furthermore, the axes of rotation of members 30 are disposed substantially equidistantly from the feed tube 12 and the body of plasma formed during operation. It should be understood that the use of three movable members is representative only, and that various other numbers of movable members may be employed as long as the plurality of movable members are disposed substantially symmetrically about the body of plasma. It is further noted that the movable members are disposed such that they are movable in planes disposed generally radially of the spherical body of plasma.

Figure 3:
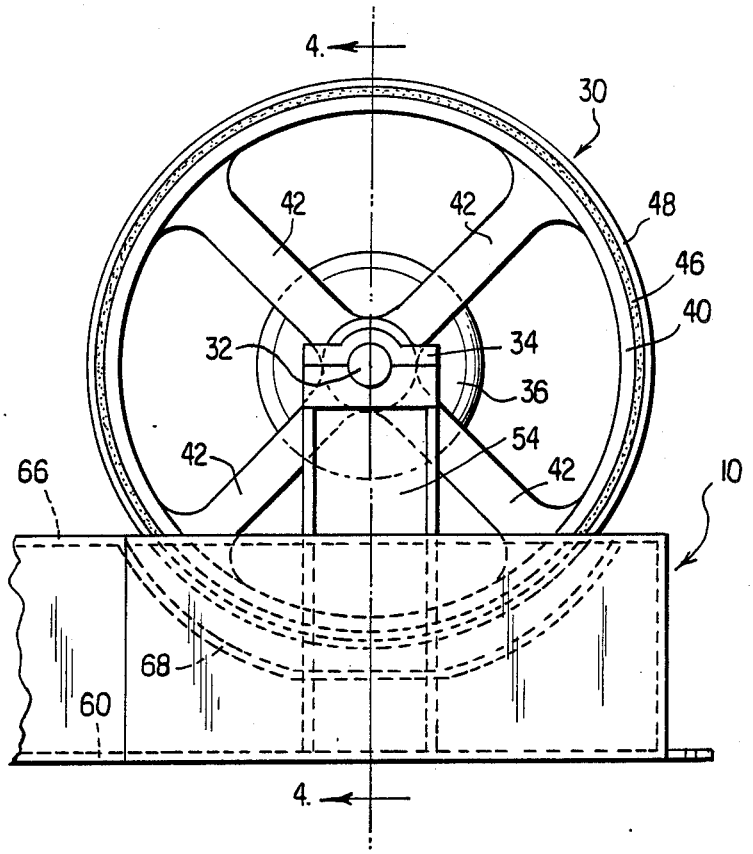
FIG. 3 is side view on an enlarged scale of one of the rotatable members shown in FIGS. 1 and 2 illustrating the details of construction thereof.
Figure 4:
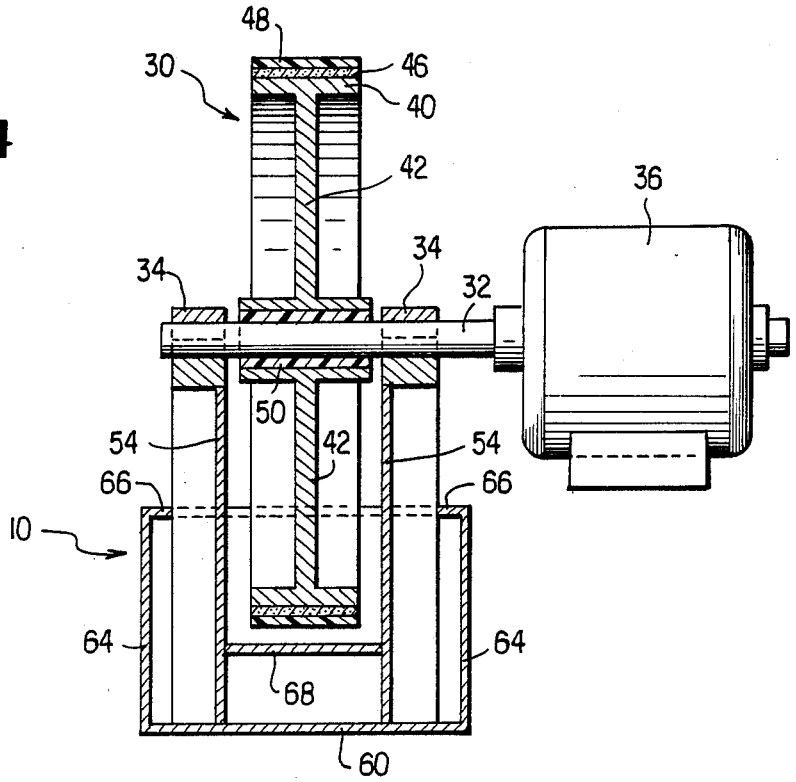
FIG. 4 is a sectional view taken along line 4—4 of FIG. 3 looking in the direction of the arrows.

Referring now to FIG. 3 and 4, each of the movable members 30 includes an enlarged rim portion 40, radial arms 42 and a hub portion 44. Supported on the outer surface of the rim is a band 46 of material which is of high permeability material, or which has low hysteresis losses. Any suitable material such as soft iron or various know alloys may be utilized to provide the portions of high permeability material. A layer 48 of heat resistant material such as ceramic or the like is preferably provided on the outer surface of band 46 in order to prevent damage from the high heat produced by the body of plasma.

The hub 44 of the movable means is conected by a cylindrical body 50 formed of a dielectric material to the drive shaft 32. The dielectric material may for example be hard rubber or the like and serves to electrically insulate the portions of high permeability material from ground.

It will be seen that in operation, members 30 are rotated such that the outer surfaces thereof move adjacent the body of plasma. The portions 46 of high permeability material cooperate with the magnetic field of the body of plasma to produce forces of magnetic attraction between the body of plasma and the portions 46 to thereby produce a retaining force on said body of plasma. Memebers 30 rotate in the direction of arrows R as seen in FIGS. 1 and 2 so that those portions of the movable members adjacent the body of plasma move in a direction upwardly and away from or upwardly of the body of plasma, thereby producing forces which retain the body of plasma in a centered suspended position between and spaced from the rotating members.

As seen in FIGS. 3 and 4, the journals 34 are mounted at the upper ends of channel members 54 the lower ends of which are supported on the bottom wall 60 of the base. As seen in FIG. 2, the channel members cooperate with inner wall portions 62 of the base to define the inner side of a passageway formed in the base for receiving a coolant as hereinafter described. The outer side of the passageway is defined by outer wall portions 64 of the base. The bottom of the passageway is defined by bottom wall 60, and the top of the passageway is defined by top wall 66 of the base thereby forming an enclosed passageway. The walls of the base are disposed such that the lower parts of members 30 will pass through recesses in the base defined between spaced inner wall portions 62 as members 30 rotate. The bottoms of these recesses are defined by walls 68.

An inlet 70 is connected to a suitable source of coolant such as liquid nitrogen, the coolant circulating through the passageway in the base as indicated by the arrows C in FIG. 2 and thence outwardly through an outlet 72. The coolant does not come into direct contact with the rotatable members 30, but the tolerance between members 30 and wall portions 62 and 68 is minimal so that there will be an efficient heat transfer. In order to provide effective cooling, the portions of the walls of the base adjacent to members 30 may be good heat conductors, while the remaining portions of the walls of the base may be formed of a heat insulating material.

Referring again to FIG. 1, dashed line 80 represents a conventional gas or vacuum tight chamber in which the apparatus may be mounted. The dashed line 82 represents a conventional heat exchanger which may be used to extract heat from the apparatus. It is apparent that various arrangements may be employed to utilize the energy created by the invention.

In the method according to the invention, a body of ionized plasma is formed having an oscillating magnetic field. Forces of magnetic attraction are applied to the body of plasma by moving material of high permeability through the oscillating magnetic field. The forces of attraction are applied in planes extending generally radially of the body of plasma and in a generally upward and outward direction relative to the body to thereby retain the body of plasma in a centered suspended position.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. The method of containing a body of ionized plasma having an oscillating magnetic field, comprising positioning a plurality of articles of high permeability material adjacent to said plasma, said high permeability material being substantially non-magnetic per se and not adapted to generate a substantial magnetic field independently of said plasma, and maintaining said articles in position relative to said plasma to produce forces of magnetic attraction between said high permeability material and said plasma and thereby retain said plasma relative to said articles without the application of an extraneous magnetic field.

2. The method defined in claim 1, wherein the body of plasma is of a generally spherical configuration, and said articles are maintained in planes extending generally radially of said body of plasma.

3. The method defined in claim 2, further including rotating said articles of high permeability material in said planes.

4. Apparatus for prolonged containment of a body of ionized plasma having an oscillating magnetic field, comprising a plurality of members formed from high permeability material, said high permeability material being substantially non-magnetic per se an not adapted to generate a substantial magnetic field independently of said plasma, said members being psotioned adjacent to said body of plasma to produce forces of magnetic attraction between said material and said plasma and thereby retain said plasma relative to said members without the application of an extraneous magnetic field.

5. Apparatus as claimed in claim 4, wherein said members are spaced substantially symmetrically about said body of plasma.

6. Apparatus as claimed in claim 4, wherein said members are positioned in planes disposed generally radially of said body of plasma.

7. Apparatus as claimed in claim 4, wherein said members are movable in a direction upwardly and away from said body of plasma.

8. Apparatus as claimed in claim 7, further including means for synchronizing the movement of said members with one another so that said members move at the same speed.

9. Apparatus as claimed in claim 4, further including means for cooling said members.

10. Apparatus for the prolonged containment of the body of ionized plasma having an oscillating magnetic field, comprising a plurality of wheel-like members lying in planes disposed adjacent to and generally radially of said body of plasma, said members having an outer portion formed from high permeability material, and means for rotating said members in said planes to cause said high permeability material to cooperate with the magnetic field of said body of plasma and produce forces of magnetic attraction between said plasma and said members, so that said body is retained in a position bounded by said movable members.

11. Apparatus as claimed in claim 10, wherein said wheel-like members are three in number and spaced symmetrically about said plasma body.

12. Apparatus as claimed in claim 10, wherein said wheel-like members have rims formed from said high permeability material.

13. Apparatus as claimed in claim 10, further including means for rotating said members in synchronism with one another.

14. Apparatus as claimed in claim 12, wherein said rims of said wheel-like members are covered with a heat resistant material.

15. Apparatus as claimed in claim 10, further including means for electrically insultaing said high permeability portions from ground.

16. Apparatus as claimed in claim 10, further including means for cooling said wheel-like members during rotation thereof.

17. Apparatus as claimed in claim 12, further including means for cooling said rims of said wheel-like members during rotation thereof.

18. Apparatus as claimed in claim 17, in which said cooling means includes means forming a passageway in which a coolant is circulated, and means mounting said member so that on rotation the rim thereof is brought into heat transfer relationship with said passageway and said coolant.

* * * * *